US005118096A

United States Patent [19]

Wilkinson et al.

[11] Patent Number: 5,118,096

[45] Date of Patent: Jun. 2, 1992

[54] AEROBIC CLIMBING STEP/BENCH

[76] Inventors: William T. Wilkinson, 1717 Town Point Rd., Chesapeake City, Md. 21915; Peter W. Bressler, 2462 Bryn Mawr Ave., Philadelphia, Pa. 19131; David R. Schiff, 2921 Poplar St., Philadelphia, Pa. 19130; Eric A. Schneider, 8235 Critenden St., Philadelphia, Pa. 19118; Pietr Lincov, 205 Sumac St., Philadelphia, Pa. 19128

[21] Appl. No.: 718,754

[22] Filed: Jun. 21, 1991

Related U.S. Application Data

[62] Division of Ser. No. 588,449, Sep. 26, 1990.

[51] Int. Cl.[5] ..... A63B 5/00

[52] U.S. Cl. ..... 482/52; 297/438; 108/12; 248/188; 248/911; 403/3

[58] Field of Search ..... 297/175, 423, 424, 438, 297/439, 445, 461; 108/11, 12, 19, 155-157, 159; 248/188, 188.2, 188.8, 911; 403/3; 211/207, 208; 272/70, 144, DIG. 4

[56] References Cited

U.S. PATENT DOCUMENTS

| | | | |
|---|---|---|---|
| 2,806,606 | 9/1957 | Evans | 108/157 X |
| 3,967,562 | 7/1976 | Anacker | 108/12 |
| 4,237,795 | 12/1980 | Parker | 108/12 |
| 4,609,192 | 9/1986 | Bratcher | 108/19 X |
| 4,879,800 | 11/1989 | Rumman | 108/156 X |

FOREIGN PATENT DOCUMENTS

| | | | |
|---|---|---|---|
| 7511686 | 4/1976 | Netherlands | 312/ |

*Primary Examiner*—Cary E. O'Connor
*Assistant Examiner*—L. Thomas
*Attorney, Agent, or Firm*—Connolly & Hutz

[57] ABSTRACT

An exercise step/bench for aerobic climbing and dance includes a base in the form of a horizontal platform having a downwardly and outwardly extending apron. A leg is reverseably mounted against the apron at each corner of the platform. The reverseable mounting of the legs permits height adjustment in accordance with the orientation of each leg.

8 Claims, 4 Drawing Sheets

AEROBIC CLIMBING STEP/BENCH

CROSS REFERENCE TO RELATED APPLICATION

This application is a division of application Ser. No. 588,449 filed Sep. 26, 1990, now allowed.

BACKGROUND OF INVENTION

Various devices exist for use in an aerobic exercise program. One type of device which has met with great success is a bench or step for aerobic step or climbing. For example, a form of single step climbing has been developed during which the user would repeatedly step up and down from a single step. An important feature for making the device capable for wide spread appeal is to permit it to be customized to the needs of the particular user in height adjustability. In U.S. Pat. No. 4,340,218 in which co-applicant William T. Wilkinson is patentee, one manner of achieving this height adjustability is disclosed. Other later patents of William T. Wilkinson disclose useful variations for accomplishing that result.

Co-pending application Ser. No. 533,004 filed Jun. 4, 1990, in the name of William T. Wilkinson also discloses a particularly advantageous manner of achieving height adjustability.

SUMMARY OF INVENTION

An object of this invention is to provide an exercise device for simulating climbing which is compact and lightweight and capable of being conveniently stored and transported.

A further object of this invention is to provide such a device which may offer a wide variety of incremental heights that are easily and quickly adjustable to accommodate the need of the particular user.

A further object of this invention is to provide an unobstructed platform surface so that the user can easily step on and off in any direction.

A still further object of this invention is to provide such a device which may be mass produced inexpensively in a simple design.

A yet further object of this invention is to provide such a device which may be used as an elevated platform for warm-up exercise.

In accordance with this invention a device of the type disclosed in co-pending application Ser. No. 533,004 is provided which is modified in its leg structure. In this respect, the device includes a horizontal platform having a downwardly and outwardly extending peripheral apron with a leg detachably mounted at each corner of the platform. In accordance with the invention each leg is reverseably mounted so that it may be selectively mounted in one of two positions. As a result, it is possible to provide height adjustability in accordance with a particular orientation of the legs with respect to the platform.

In one practice of this invention the legs are inclined and of generally straight construction having a narrow section at each end. The length of the narrow section at one end is longer than at the other end so that when the narrowed section is inserted into a complementary mounting structure of the apron the platform will be elevated in accordance with the extent to which the leg extends from the apron.

In an alternative form of this invention the leg is of curved construction and includes two portions which are generally perpendicular to each other with each portion being of differing lengths than the other portion. The height adjustability is achieved in accordance with the selection of the portion that will be vertical when the legs are mounted in place.

THE DRAWINGS

DETAILED DESCRIPTION

The present invention is directed to the type of aerobic climbing step/bench as described in co-pending application Ser. No. 533,004 filed Jun. 6, 1990, the details of which are incorporated herein by reference thereto. A basic difference between the present invention and the device as described in Ser. No. 533,004 is that the present invention achieves is height adjustability through the use of sets of legs which are selectively mounted to the platform in a reverseable manner so that differing heights are achieved with the orientation of the legs with respect to the platform.

Figure 1:
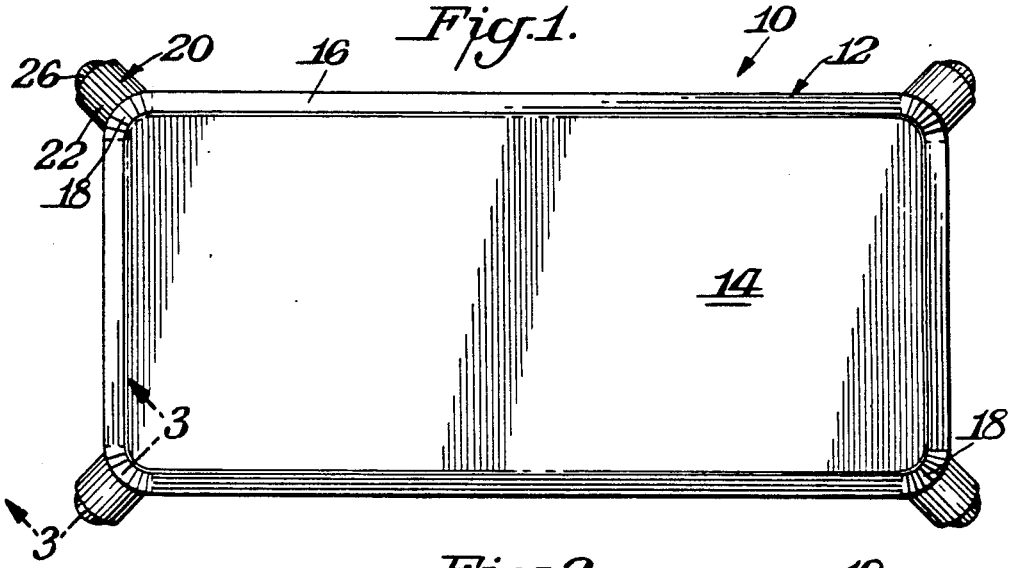
FIG. 1 is a top plan view of an aerobic climbing step/bench in accordance with this invention.
Figure 2:
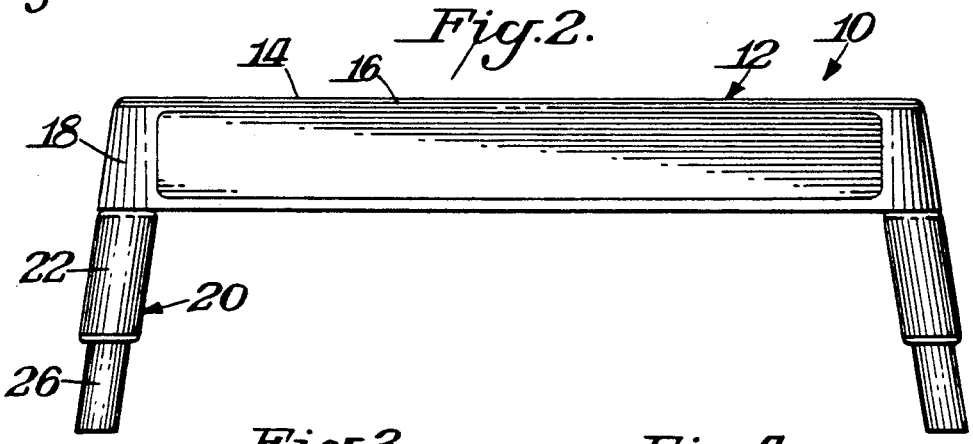
FIG. 2 is a front elevation view of the step/bench shown in FIG. 1.
Figure 3:
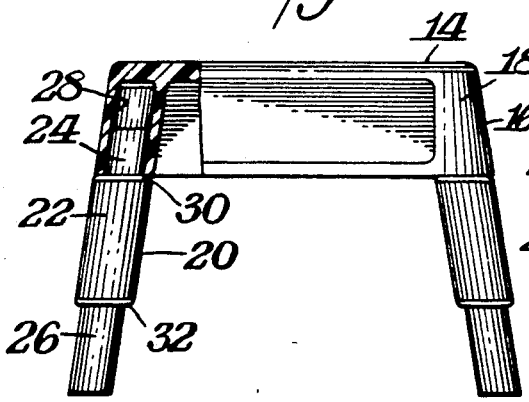
FIG. 3 is a cross sectional view taken through FIG. 1 along the line 3—3.
Figure 4:
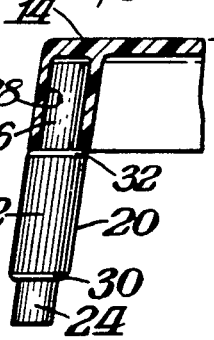
FIG. 4 is a view similar to FIG. 3 showing the leg in its reversed position.

FIGS. 1–4 illustrate a device 10 which may function as a step/bench in accordance with this invention. As shown therein device 10 includes a base 12 in a form of a horizontal platform 14 having a downwardly and outwardly extending apron 16. If desired apron 16 may be perpendicular to platform 14. A leg 20 is mounted at each corner 18 of apron 16. As best shown in FIGS. 3–4 each leg 20 is generally of tubular form and includes a central portion 22 and a pair of end portions 24,26. End portions 24,26 are made narrower than central portion 22 so as to snugly fit in complementary shaped and dimensioned pockets or channels 28 at each corner of apron 16. Where apron 16 is perpendicular, legs 20 are not inclined. Each leg 20 is inclined at the same angle as apron 16. Legs 20 are so structured that narrow portions 24,26 may both be selectively positioned in pocket 28. As is apparent, narrow portion 24 is of shorter lengths than narrow portion or extension 26. Legs 20 are dimensioned with respect to pocket 28 and apron 16 so that the lower edge of each pocket rests against shoulders 30,32 respectively of legs 20 when a narrowed portion or extension 24 or 26 is inserted into the pocket.

FIG. 3 illustrates the practice of the invention wherein the shorter narrowed extension 24 is inserted in pocket 28. In the preferred practice of this invention the height of base 12 is 4 inches. The perpendicular height of leg 20 is, for example, 10 inches with the perpendicular height of extension 24 being 2 inches and the perpendicular height of extension 26 being 4 inches. Accordingly, when legs 20 are mounted to base 12 in the position shown in FIG. 3, the overall height of the top surface of platform 14 would be 12 inches. When, however, the legs are mounted in the reverse position, as shown in FIG. 4, with the longer extension 26 being inserted in pocket 28 then the overall height of the top surface of platform 14 is 10 inches.

Figure 5:
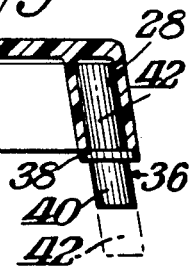
FIG. 5 is a view similar to FIG. 4 showing an alternative form of leg.
Figure 6:
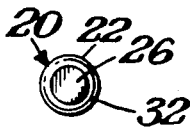
FIG. 6 is a bottom plan view of one of the legs usable with this invention.

FIG. 5 illustrates a modification of this invention wherein an extra set of legs 36 is provided having a disc like central portion or flange 38 and a pair of narrowed extensions 40,42. In this variation the overall perpendicular height of leg 36 is 6 inches while the perpendicular height of narrowed extension 42 is 4 inches and the perpendicular height of narrowed extension 40 is $1\frac{3}{4}$ inches. Accordingly, the top surface of platform 14 would be at a height of 6 inches when legs 36 are mounted as shown in FIG. 5 and would be at a height of about $8\frac{1}{4}$ inches when legs 36 are mounted in the reverse position. The two sets of legs thereby permit height adjustability of the top surface of platform 14 from 4 inches when no legs are mounted to 12 inches when leg 20 is mounted in the position shown in FIG. 3 with incremental adjustability of about 2 inches being provided therebetween.

Legs 36 would be provided along with legs 20 to provide a complete set of legs.

Figure 7:
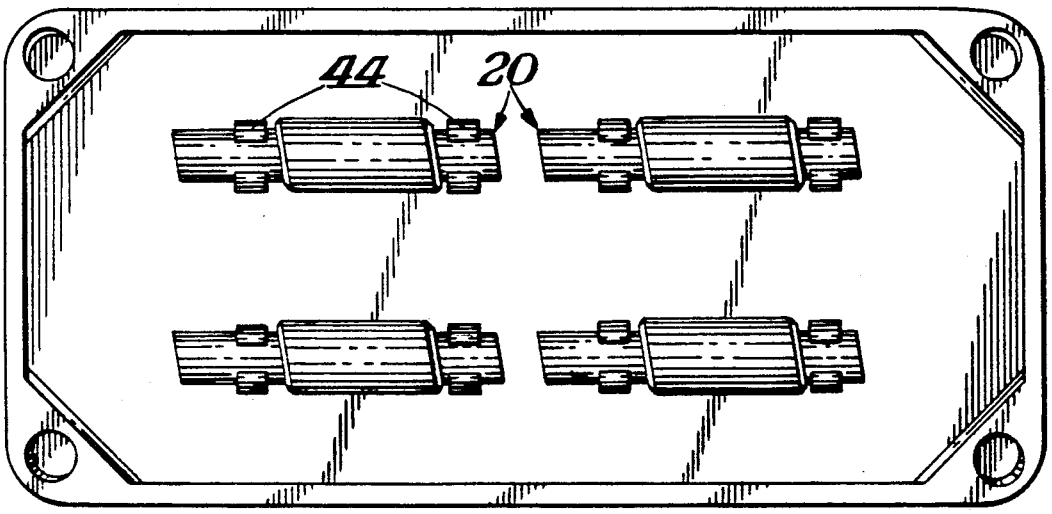
FIG. 7 is a bottom plan view of the step/bench showing the legs of FIGS. 1–4 in the stored position.

FIG. 7 illustrates an advantageous feature of this invention wherein the legs may be stored on the underside of base 12 within the periphery of apron 16 during conditions of non-use. As illustrated each leg 20 is held in place in any suitable manner with the illustrated manner being spring clips 44. Although not shown the shorter legs 36 may also be stored within the periphery of apron 16 by being mounted such as by spring clips to the underside of platform 14 or to the inner side of apron 16.

FIGS. 8–11 show a variation of this invention wherein the legs 50 are of a different type of structure than legs 20 or 36. In the prior embodiments pocket 28 is dimensioned to be of complementary shape and size to the extensions of the particular legs. The length of each pocket would also be of generally the same length as the longer extensions 26 or 42. In the embodiment of FIGS. 8–11 legs 50 are of inverted L-shape and the mounting is achieved by forming a slot or recess 52,54 in the perpendicular extensions 56,58 of leg 50. The recesses 52,54 are dimensioned to snugly engage the downwardly extending apron 16 of base 12.

Figure 8:
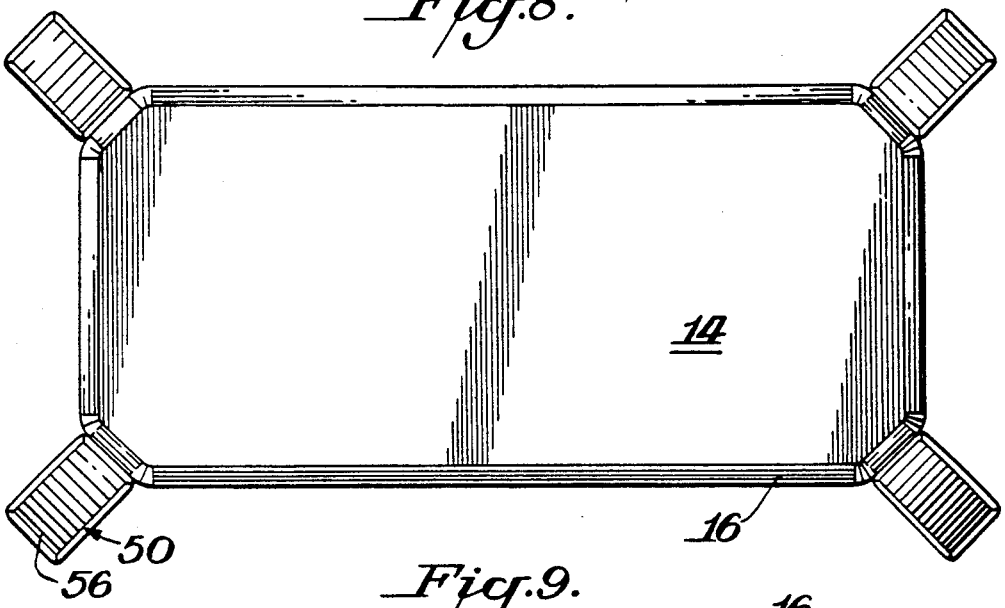
FIG. 8 is a top plan view of an alternative view of the step/bench in accordance with this invention.
Figure 9:
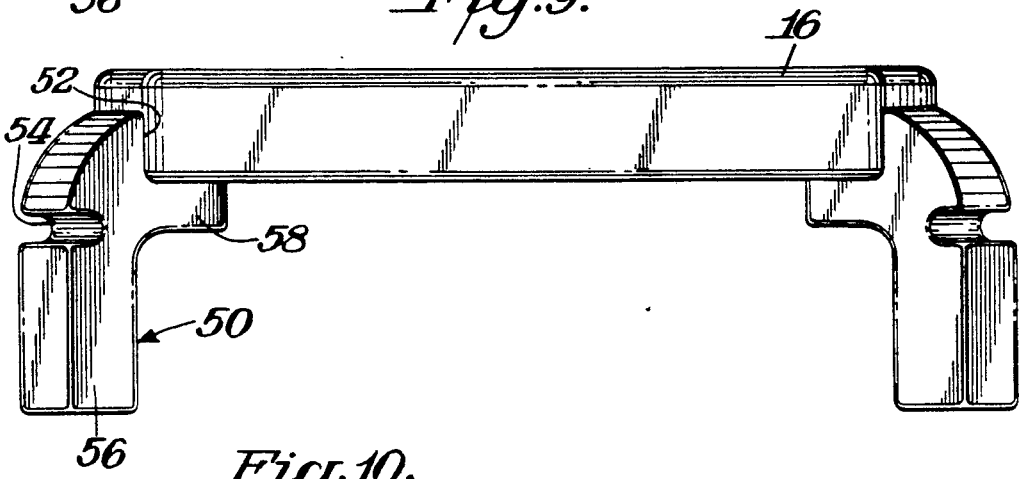
FIG. 9 is a side elevation view of the step/bench of FIG. 8.
Figure 10:
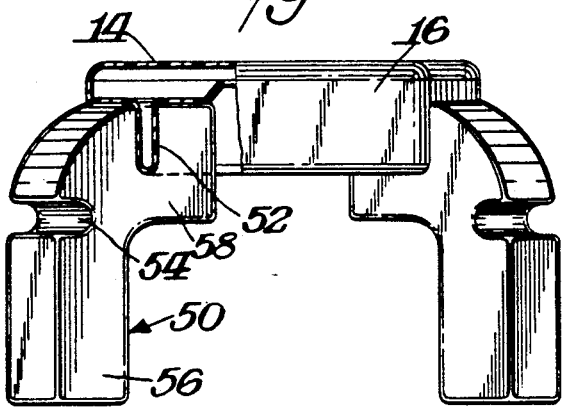
FIG. 10 is an end elevation view partly in section of step/bench of FIGS. 8–9.
Figure 12:
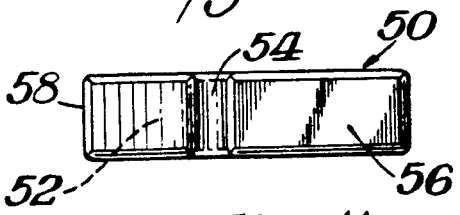
FIG. 12 is a top plan view of the leg shown in FIG. 11.

In the preferred practice of this invention the overall height of the top surface of platform 14 when longer extension 56 is vertically disposed as in FIGS. 8–10 would be 12 inches. When, however, the position of legs 50 is reversed to that of FIG. 11 so that the shorter extension 58 is vertical the overall height of the top surface of platform 14 would be 10 inches.

Figure 13:
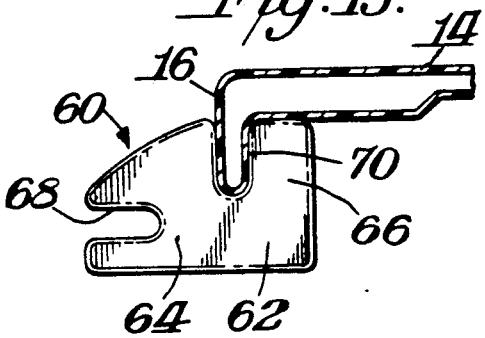
FIG. 13 is a view similar to FIG. 11 of a modified form of leg.

FIG. 13 illustrates a variation of this invention wherein the leg 60 is formed as a hollow block 62 having a long side 64 and a shorter side 66 with a pair of channels or recesses 68,70. When leg 60 is mounted in the position shown in FIG. 13 with the shorter side 66 being vertical, the overall height of top surface 14, is for example, 6 inches. When, however, the position of legs 60 is reversed so that longer sides 66 are vertical the overall height or elevation or top surface of platform 14 would be 8 inches. Thus, height adjustability is possible with the provision of legs 50 and 60 over a range of 4 inches when no legs are used to 12 inches when leg 50 is used in the position used in FIGS. 8–10.

Legs 60 would be provided with legs 50 to provide a complete set of legs.

Figure 14:
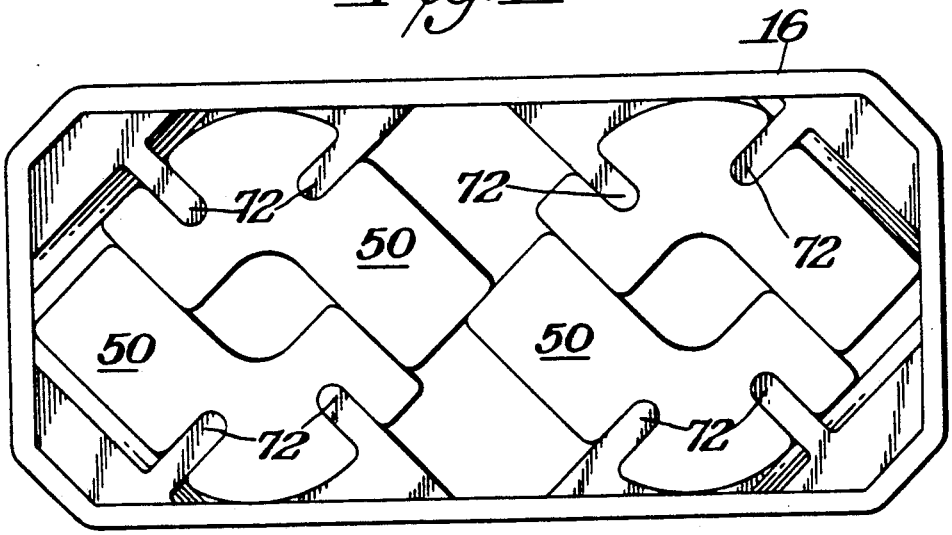
FIG. 14 is a bottom plan view of the step/bench of FIGS. 8–12 showing the legs in their stored position.

FIG. 14 illustrates the legs 50 stored on the undersurface of base 12 during conditions of non-use. As shown therein the undersurface of base 12 includes raised projections 72 which snugly fit in the respective recesses or channels 52,54 of legs 50 to mount the legs in place. Projections 72 could be formed from or lined with resilient material to assure a tight yet detachable fit in the respected recesses. Other forms of mounting could be used such as spring fingers as previously described. Although not illustrated the shorter leg 60 could be mounted on the inside wall of apron 16.

Figure 11:
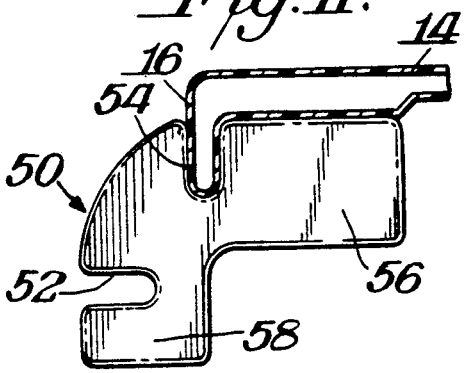
FIG. 11 is a cross-sectional view taken through in elevation of the step/bench of FIG. 8.

As is apparent, the invention thus provides a convenient manner of achieving height adjustability through the use of reverseably mounted legs so that a range of height adjustment is selectively attainable by selectively using the platform without any legs or by selectively mounting the legs to the platform and adjusting the height in accordance with the orientation of the respective legs in their connection to base 12. The embodiment of FIGS. 1–7 has the advantage in its simplicity of structure. The embodiments of FIGS. 8–14 has the advantage of providing an elongated surface under platform 14 to facilitate the stability of the mounting and support for base 12. As shown in FIGS. 10,11 and 13 the lower surface of platform 14 rests directly on the inwardly extended horizontal portion of each leg.

Although the invention has been described with respect to its preferred embodiments wherein the range of adjustability is from 4 inches to 12 inches, the invention may be practiced with other ranges of height adjustment. For example, leg 50 in the illustrated embodiment of this invention is intended to have an overall height which would result in the top surface of platform 14 being either 10 or 12 inches, depending upon the orientation or leg 50. This is achieved by dimensioning the bottom of longer extension 56 being 8 inches below the base of recess 52 while the bottom of shorter extension 58 is 6 inches below the base of recess 54. Accordingly, the 4 inches added height of base 12 would make the resultant overall height 10 inches and 12 inches respectively. Similarly, leg 60 is dimensioned so that the length between the base of channel 70 and the lower surface of side 64 is 2 inches while the distance between the base of channel 68 and the lower edge of side 66 is 4 inches. By providing other dimensions different height adjustments for platform 14 are possible.

In the embodiment shown in FIGS. 1–7 apron 16 is illustrated as being angularly inclined. The invention, however, may be practiced where apron 16 is generally perpendicular to the top surface of platform 14. FIGS. 8–14, for example, illustrate such an embodiment. Similarly, the respective channels 52,54 68,70 of legs 50 and 60 could be angularly arranged where apron 16 is inclined.

What is claimed is:

1. An exercise device for use in aerobic step climbing routines/programs comprising a base, said base consisting of a horizontal platform having opposite ends and intermediate sides with a downwardly extending apron extending from each of said ends and sides, a corner where each of said ends is joined to each of said sides, at least one leg mounted to said base at each of said ends, each of said legs including a long flat side and an adjacent short flat side and having an edge opposite each of said sides, each of said legs being detachably mounted so as to be movable from an active position to a stored condition, each of said legs having mounting structure for cooperating with complementary mounting structure on said apron to selectively reversibly mount said legs to said apron whereby the overall height of said platform may be adjusted in accordance with the selective mounting of said legs to said apron, said mounting structure comprising channels in edges located generally perpendicular to each other on each of said legs, and each of said channels being formed in an edge opposite a respective one of said sides.

2. The device of claim 1 wherein each of said legs has the shape of an inverted L comprising a pair of extensions joined to each other, and one of said channels being formed in a respective one of said extensions.

3. The device of claim 1 wherein each of said legs is formed of block like shape having a curved surface remote from said flat sides, and said channels being formed in said curved surface.

4. The device of claim 1 wherein said apron is snugly received in a respective one of said channels.

5. The device of claim 1 wherein each of said legs rests against and supports the underside of said platform.

6. The device of claim 1 including mounting means on the undersurface of said base for mounting said legs to said undersurface of said base within the periphery of said apron when said legs are in their stored condition.

7. The device of claim 1 wherein said device has height adjustability from about 4 inches when no legs are mounted to said apron to 12 inches.

8. The device of claim 1 wherein one of said legs is mounted to each of said corners.

* * * * *